US006014935A

United States Patent [19]

Willett

[11] Patent Number: 6,014,935

[45] Date of Patent: Jan. 18, 2000

[54] ALL WEATHER OUTDOOR TABLE COVER

[76] Inventor: Timothy Willett, 6862 Lindbergh Ave., Edwards AFB, Calif. 93523

[21] Appl. No.: 09/036,982

[22] Filed: Mar. 9, 1998

[51] Int. Cl.[7] ..... A47B 13/08

[52] U.S. Cl. ..... 108/90; 108/50.11

[58] Field of Search ..... 108/90, 50.11; 150/158, 159

[56] References Cited

U.S. PATENT DOCUMENTS

| | | | |
|---|---|---|---|
| D. 325,145 | 4/1992 | Issac . | |
| 3,279,515 | 10/1966 | Kesh | 108/90 |
| 3,295,577 | 1/1967 | Danielson | 180/90 X |
| 3,637,454 | 1/1972 | Pavernick . | |
| 4,328,271 | 5/1982 | Rountree . | |
| 4,337,812 | 7/1982 | Trinker . | |
| 4,393,104 | 7/1983 | Fink . | |
| 4,691,955 | 9/1987 | Pousar . | |
| 4,705,084 | 11/1987 | Rodebaugh et al. | 108/90 X |
| 4,750,402 | 6/1988 | Markey | 108/90 X |
| 4,800,108 | 1/1989 | Swartz . | |
| 4,813,166 | 3/1989 | Drake | 108/90 X |
| 4,982,516 | 1/1991 | Cervantes | 108/90 X |
| 5,339,748 | 8/1994 | Bilotti | 108/90 |
| 5,582,115 | 12/1996 | Muller | 108/90 |
| 5,694,866 | 12/1997 | Muller | 108/90 X |
| 5,765,487 | 6/1998 | Neff | 108/90 X |

*Primary Examiner*—Jose V. Chen
*Attorney, Agent, or Firm*—Dennis Beech

[57] ABSTRACT

The all weather outdoor table cover has a tablecloth for placement on a table and straps attached at the tablecloth perimeter to provide for securing to the table top. A protective cover is attached to a portion of the tablecloth perimeter and is constructed of a pliable material so it may be folded for storage when not in use. A hem is formed in the perimeter of the protective cover and has a draw cord contained therein which is accessible through two openings. When it is desired to cover the table and its contents, the protective cover may be pulled over the table top and secured under it by pulling on the draw cords to pull the protective cover under the table top. This will protect the tablecloth and contents from weather, pests and the like. Storage pockets may also be attached to the perimeter of the tablecloth.

15 Claims, 2 Drawing Sheets

ALL WEATHER OUTDOOR TABLE COVER

BACKGROUND OF THE INVENTION

1. Field of the Invention

This invention relates to table covers or tablecloths and more particularly to table covers for outdoor use where environmental conditions require protective covering. The new device provides a cover for a table as well as a cover to protect the table contents from inclement weather or pests.

2. Description of the Related Art

Tablecloths or table covers have long been in use for both indoor and outdoor dining. Such use is traditionally for both decoration and to protect the table. In addition, when used outdoors the table cover may serve to cover a table surface which is dirty or in some manner damaged. In this use the table cover serves to provide a clean eating surface.

Combination table covers and carry bags are also known in the art as for example in U.S. Pat. No. 4,337,812. In this case the device serves as a table cover and carry bag for elements desired for camping or picnicking. While the table cover includes organizing pockets for dishes and utensils, it has no provision for protection of table contents in the outdoor environment.

The present invention provides a tablecloth for the table surface as well as a protective cover to protect the items placed on the table cover when not in use. Pockets for storage of items may also be attached to the table cover. When used outdoor the invention may be used to cover a table and have meal items and utensils placed thereon. The protective cover may be used to cover the table contents to protect them from the environment. When it is desired to use the table the protective cover is simply removed and stored.

SUMMARY OF THE INVENTION

One object of the present invention is to provide a table cover which includes a protective cover for the contents of the table. Another object is for adjustability of the table cover to various size table tops. A further object includes storage of items in pockets when not in use.

In accordance with the description presented herein, other objectives of this invention will become apparent when the description and drawings are reviewed.

DESCRIPTION OF THE PREFERRED EMBODIMENT

The all weather outdoor table cover has a tablecloth with attachment straps to strap the device to a table. A protective cover is attached to a portion of the tablecloth edge or perimeter such that it may be folded up for storage when not in use. The table cover may also have storage pockets attached at an edge. When the tablecloth is fastened to the table it may be covered, including any items placed on the table, by the protective cover. The protective cover has draw cords to allow drawing the protective cover hem edge under the table to retaining it.

Figure 1:
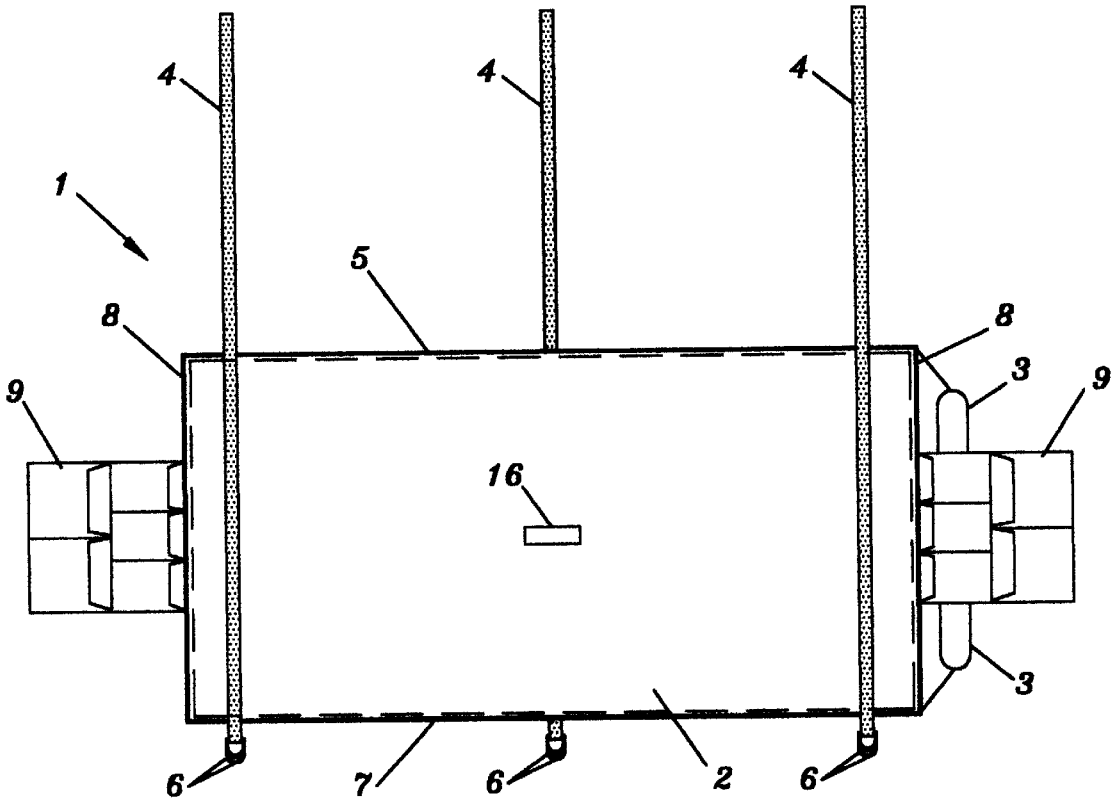
FIG. 1 illustrates a top plan view of a rectangular embodiment of the table cover with protective cover stored.
Figure 2:
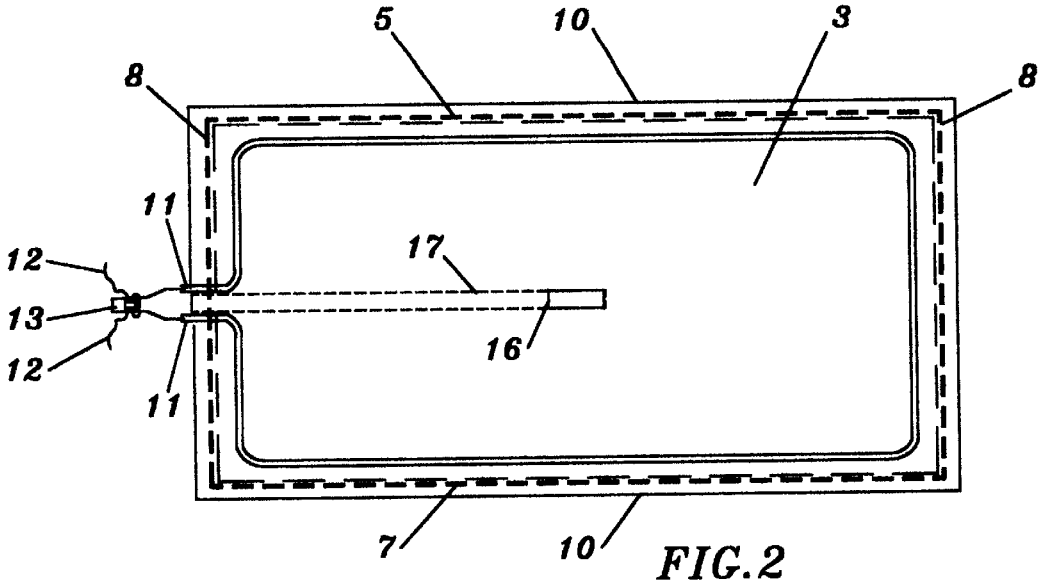
FIG. 2 illustrates a bottom plan view of the protective cover enclosing the table contents.

Referring to FIGS. 1 and 2, the table cover (1) is illustrated with tablecloth (2) and protective cover (3). The tablecloth (2) has three straps (4) attached at an edge (5) with strap fasteners (6) such as buckles, hook and loop and the like attached on the opposite edge (7). The tablecloth (2) is generally rectangular in shape and sized to fit a variety of sizes of outdoor picnic tables. To install the table cover (1) the tablecloth (2) is placed on a table top and folded as necessary for proper length. The straps (4) are then wrapped under the table top and fastened by buckle rings (6).

The protective cover (3) is normally fastened at one end (8) of the tablecloth (2). In FIG. 1 a portion of the edge of the protective cover (3) is shown attached to end (8) by for example sewing or other suitable means and is folded and stored. In this embodiment there are storage pockets (9) attached at each end (8) of the tablecloth (2) and the protective cover (3) is stored under a storage pocket (9).

Items and utensils for a meal may be placed on the tablecloth (2) in this configuration. If it is then desired to leave the table set until the next use, the protective cover (3) may be unfolded and pulled over the tablecloth (2) and its contents. The storage pockets (9) may be folded up onto the tablecloth (2) or left draped off the end of the table. The protective cover (3) has a hem (10) formed around the perimeter with the hem (10) having two openings (11). A continues draw cord (12) is contained in the hem (10). The hem (10) is pulled under the table top and the draw cord (12) used to draw the hem (10) under the table top edge and hold the protective cover (3) on the table. A locking device (13) may be slidably engaged on the ends of the draw cord (12).

Figure 5:
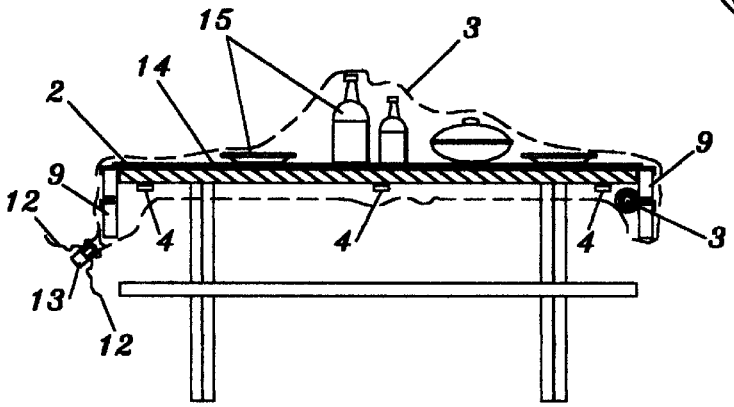
FIG. 5 illustrates a side elevation sectional view of the table cover installed on a table.

As viewed in FIG. 5, the table cover (1) is placed on a table top (14) and strapped to the table by straps (4). Items and utensils (15) are placed on the tablecloth (2) and stored in storage pockets (9). The protective cover (3) is shown in ghosted form as installed to cover the table top (14) and the contents placed on the tablecloth (2).

Figure 3:
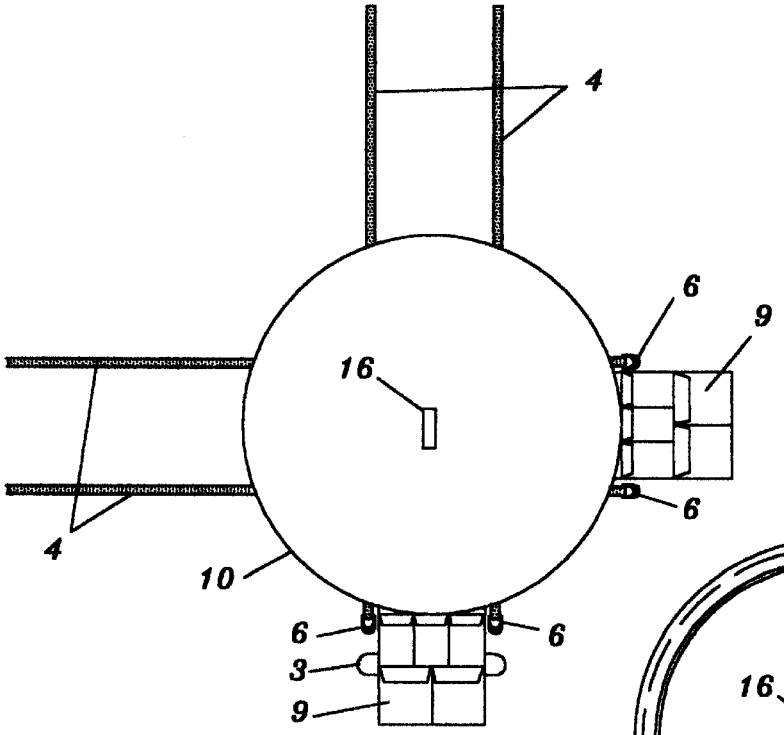
FIG. 3 illustrates a top plan view of a circular embodiment of the table cover with protective cover stored.
Figure 4:
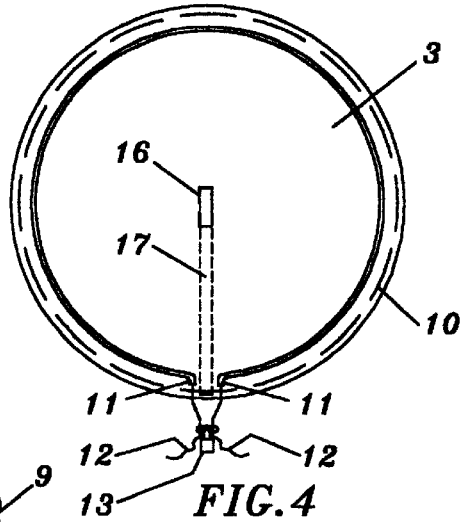
FIG. 4 illustrates a bottom plan view of the protective cover enclosing the table contents.

Referring to FIGS. 3 and 4, an alternate shape of the table cover (1) is shown for use with round tables. In this embodiment straps (4) are crossed under the table top to secure the tablecloth (2) to the table. The storage pockets (9), if used, may be placed at a convenient location on the perimeter of the tablecloth (2). Likewise the protective cover (3) may be attached to the tablecloth along a portion of the perimeter at a convenient location or a portion of the edge of the protective cover (3) attached by for example sewing or other suitable means to the storage pockets (9). The protective cover is illustrated as being stored under one of the storage pockets (9).

Both embodiments also include an aperture (16) to allow use with tables that have umbrellas. In such instances the protective cover (3) has a split (17) to allow pulling the protective cover (3) around the pole of an umbrella. The split (17) may then be closed by hook and loop, snaps and the like attachment means. The table cover (1) is constructed of durable, pliable, water resistant material such as vinyl, plastic and the like to allow ease of use and for folding and easy transport. With the protective cover (3) installed the table contents are protected from weather, pests and the like.

I claim:

1. A table cover comprising:

a tablecloth having a plurality of straps attached to an edge of the tablecloth with a strap fastening means attached at an edge opposite each strap;

a protective cover attached at a portion of the protective cover perimeter by a means for attachment to a portion of the tablecloth perimeter;

a hem formed adjacent the perimeter of the protective cover and containing two openings therein; and a draw cord contained within the hem graspable through the hem openings for drawing the protective cover perimeter under a table top.

2. The table cover as in claim 1 wherein the tablecloth has an aperture defined therein.

3. The table cover as in claim 1 wherein there is a storage pocket attached to the perimeter of the tablecloth.

4. The table cover as in claim 1 wherein there is a locking device slidably mounted on the draw cord.

5. The table cover as in claim 1 wherein the protective cover is constructed of a pliable water resistant material.

6. The table cover as in claim 1 wherein the protective cover has an aperture defined therein.

7. The table cover as in claim 1 wherein the protective cover has a split defined therein which has a closure means.

8. A table cover comprising:

a tablecloth having a protective cover attached at a portion of the protective cover perimeter by a means for attachment to a portion of the tablecloth perimeter;

a hem formed adjacent the perimeter of the protective cover and containing two openings therein; and a draw cord contained within the hem graspable through the hem opening for drawing the protective cover perimeter under a table top.

9. The table cover as in claim 8 wherein the tablecloth has an aperture defined therein.

10. The table cover as in claim 8 wherein there is a storage pocket attached to the perimeter of the tablecloth.

11. The table cover as in claim 8 wherein there is a locking device slidably mounted on the draw cord.

12. The table cover as in claim 8 wherein the protective cover is constructed of a pliable water resistant material.

13. The table cover as in claim 8 wherein the protective cover has an aperture defined therein.

14. The table cover as in claim 8 wherein the protective cover has a split defined therein which has a closure means.

15. A table cover comprising:

a tablecloth having a storage pocket attached to the perimeter of the tablecloth;

a protective cover attached at a portion of the protective cover perimeter to the storage pocket;

a hem formed adjacent the perimeter of the protective cover and containing two openings therein; and a draw cord contained within the hem graspable through the hem openings for drawing the protective cover perimeter under a table top.

* * * * *